United States Patent [19]

Nishioka

[11] 4,085,886

[45] Apr. 25, 1978

[54] RECLOSABLE TWIN-Z-FOLD DISPENSING VALVE CONSTRUCTION FOR A LIQUID CONTAINING FILM POUCH

[75] Inventor: Masato Nishioka, Cincinnati, Ohio

[73] Assignee: The Procter & Gamble Company, Cincinnati, Ohio

[21] Appl. No.: 756,442

[22] Filed: Jan. 3, 1977

[51] Int. Cl.[2] ..... B65D 33/38

[52] U.S. Cl. ..... 229/62.5

[58] Field of Search ..... 150/1, 9, 3; 229/66, 229/62.5; 222/107, 211, 491, 541; 251/4

[56] References Cited

U.S. PATENT DOCUMENTS

| | | | |
|---|---|---|---|
| 3,430,842 | 3/1969 | Yamaguchi | 229/62.5 |
| 3,815,810 | 6/1974 | Wellman | 229/66 X |

*Primary Examiner*—Joseph F. Peters, Jr.
*Assistant Examiner*—Norman L. Stack, Jr.
*Attorney, Agent, or Firm*—Meville, Strasser, Foster & Hoffman

[57] ABSTRACT

An automatically reclosable dispensing valve construction for a liquid-containing film pouch of the type comprising first and second flexible film walls or sides joined together at their peripheral edges. A twin-Z fold, incorporating both sides of the pouch, is formed extending between two spaced apart pouch edge portions and the edge portions of the pouch at the fold are joined together to maintain the fold. When a portion of the pouch beyond the fold is removed to form a dispensing opening, the twin-Z fold serves as the reclosable valve partially unfolding and permitting passage of the liquid from the pouch through the dispensing opening when the pouch is subjected to a squeezing force and refolding to prevent passage of the liquid from the pouch through the dispensing opening upon release of the squeezing force.

8 Claims, 12 Drawing Figures

RECLOSABLE TWIN-Z-FOLD DISPENSING VALVE CONSTRUCTION FOR A LIQUID CONTAINING FILM POUCH

BACKGROUND OF THE INVENTION

1. Field of the Invention

The invention relates to a reclosable valve construction for a liquid containing film pouch, and more particularly to such a valve which is an integral part of the pouch and automatic in its action.

2. Description of the Prior Art

The reclosable twin-Z-fold valve construction of the present invention is applicable to many types of structures having film walls and from which or through which a liquid is to be dispensed. For purposes of an exemplary showing, the invention will be described in its application to liquid-containing film pouches.

Pouches made of flexible films to contain liquid commodities are becoming of ever increasing interest as a simple and inexpensive substitute for bottles, jars, cans and the like. Such pouches may contain many types of liquids such as liquid detergents, liquid laundry softeners, shampoos, liquid foodstuffs, cooking oils, liquid medicaments, liquid topical preparations and the like. Prior art workers have devised various types of such pouches intended for a single use, a portion of the pouch being torn or cut away to permit the dispensing of its contents. U.S. Pat. No. 3,670,927 in the name of Alan M. Hubbard, issued June 10, 1972, is exemplary of such a single-use pouch.

There are instances, however, when it is desirable to provide a film pouch which is reclosable so that all of its contents need not be used at one time. As a consequence, prior art workers have devised various film pouches having dispensing orifice plugs, clamps or other mechanical devices enabling the pouch to be reclosed and stored. U.S. Pat. No. 2,815,150 in the name of Albert M. Herzig, issued Dec. 3, 1957 and U.S. Pat. No. 3,315,849 in the name of Albert M. Herzig, issued Apr. 25, 1967, are exemplary of those patents teaching film pouches provided with integral or separate mechanical means enabling the closure of the dispensing opening of the pouch.

U.S. Pat. No. 3,815,794 in the name of Richard S. Carlisle, issued June 11, 1974, describes a pouch-like container of supple plastic film having an integral spout of particular configuration which will permit dispensing of the pouch contents when the pouch is subjected to a squeezing force and which will automatically reclose upon release of the squeezing force. This pouch comprises two plastic films heat sealed together and cut in such a way as to provide a spout of particular shape and dimensions. By varying the shape and dimensions of the spout the nature of the seal across its discharge passage and force required to dispense contents from the pouch may be varied. It is important that the seal about the periphery of the pouch be as thin and flat as possible.

The present invention provides a reclosable dispensing valve construction for a liquid-containing film pouch wherein the valve is an integral part of the pouch achieved by simple folding and sealing steps. No extra materials are necessary. No additional plugs, clamps or other mechanical devices are required. Film pouches provided with the valve construction of the present invention are simple and inexpensive to manufacture with minimal waste and high volumetric efficiency.

Finally, the reclosable valve does not require the provision of an elongated and particularly configured spout.

SUMMARY OF THE INVENTION

The reclosable dispensing valve construction of the present invention is applicable to pouches or containers of the type having two walls or sides joined or sealed together at their peripheral edges and intended to contain a liquid commodity. The valve is formed by providing a Z-fold in the pouch, extending between two spaced apart pouch edge portions. Since the fold involves both sides of the pouch, it is in reality a twin-Z fold. The twin-Z fold is maintained by virtue of the fact that its ends at the pouch edges are sealed together. Throughout the majority of the length of the fold, however, the pouch sides are separate and discrete (i.e. not sealed together).

When the liquid-containing film pouch, provided with the reclosable dispensing valve of the present invention, is to be used, a portion of the pouch beyond the discharge end of the twin-Z fold valve may be cut or torn away to form a dispensing opening. When a squeezing force is applied to the body of the pouch beyond the intake side of the twin-Z-fold valve, the valve will partially unfold, permitting passage of the liquid from the pouch through the dispensing opening. Upon release of the squeezing force, the twin-Z-fold valve will reclose by returning to its normal condition whereby further passage of liquid from the pouch to the dispensing opening is prevented. The reclosed pouch may thereafter be set aside for subsequent use.

DESCRIPTION OF THE PREFERRED EMBODIMENTS

Figure 1:
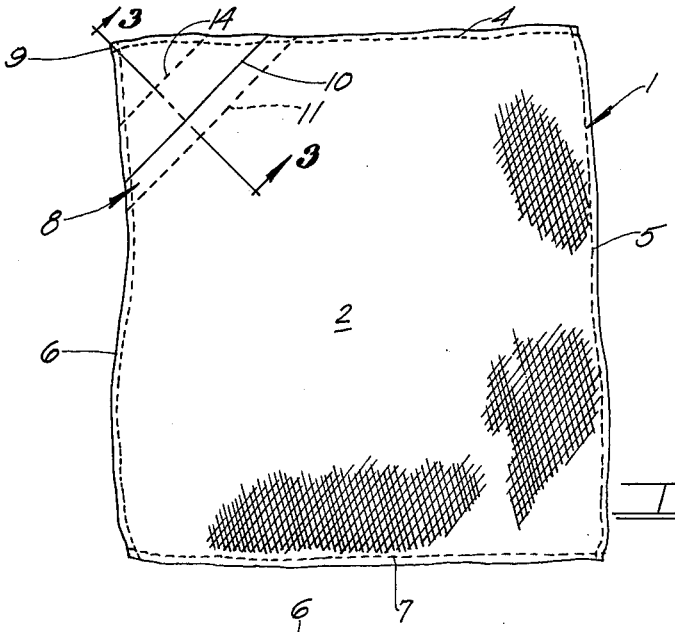
FIG. 1 is an elevational view of a liquid-containing film pouch provided with the reclosable valve construction of the present invention.
Figure 2:
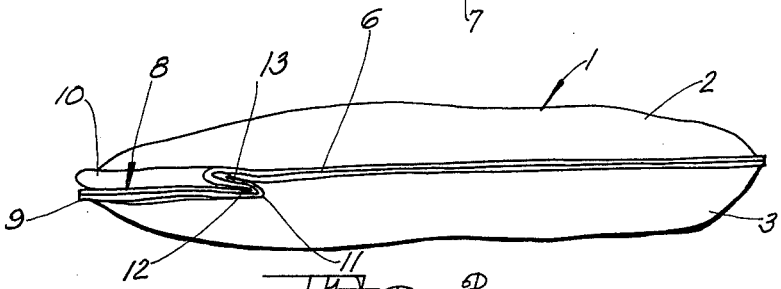
FIG. 2 is a side view of the pouch as seen from the left in FIG. 1.

Attention is first directed to FIGS. 1 and 2 wherein a liquid-containing film pouch is shown, provided with the reclosable twin-Z-fold valve of the present invention.

The pouch is generally indicated at 1 and comprises a first side 2 and a second side 3. The sides 2 and 3 may be made of like or dissimilar flexible films. The films may be paper, cloth, rubber, metal foil, plastic or laminates of two or more of the above. Where paper or cloth is to be used, it must either be treated to be liquid-proof or laminated with a liquid-proof material adapted to be in contact with the liquid contents of the pouch. For most uses a plastic material is preferred. Typical of such plastic materials are polyethylene, polypropylene, polyvinyl chloride, nylon or the like. Again, laminates of such materials, as are well known in the art and readily available, may be used. In general it is believed that the nature of the material from which the film sides 2 and 3 are made does not constitute a limitation on the present invention. The material must, however, be liquid-proof, sufficiently flexible and compatible with the liquid commodity to be contained within the pouch 1.

For purposes of an exemplary showing, the pouch 1 is illustrated as being substantially rectangular in configuration. The top edges of sides 2 and 3 are sealed together, as is indicated by broken line 4. In similar fashion, the side and bottom edges of the sides 2 and 3 are sealed together as indicated by broken lines 5, 6 and 7. Depending upon the nature of the material from which sides 2 and 3 are made, the sealing may be accomplished by gluing, heat sealing, ultrasonic welding or the like. The particular sealing method used does not constitute a limitation on the present invention and the choice of appropriate sealing method is well within the skill of the worker in the art.

The reclosable dispensing valve of the present invention is generally indicated at 8. The valve comprises a Z-fold formed in the pouch, located inwardly of a corner 9 thereof and extending between the top and side edges of the pouch which form corner 9. As can be most clearly determined from FIG. 2, the Z-fold in the pouch incorporates both sides 2 and 3 (thus constituting a twin-Z fold) and is made up of a first fold 10 and a second oppositely directed fold 11.

As will be evident from FIG. 1, the seal lines 4 and 6 pass through the twin-Z fold at its ends. Thus sealed at its ends, the twin-Z fold becomes the reclosable valve which is permanently formed in the pouch 1, and is hereafter designated the twin-Z-fold valve 8. The left hand end (as viewed in FIG. 1) of the twin-Z-fold valve 8 is shown in FIG. 2. Assuming for purposes of an exemplary description that the pouch sides 2 and 3 are polyethylene and that the seal 6 is accomplished by well known heat sealing techniques, it will be noted that the heat seal 6 runs throughout the edge of the twin-Z-fold valve 8. At the same time, the exterior surface of side 2 is sealed to itself at 12 and the exterior surface of side 3 is sealed to itself at 13. Thus, both the interior and exterior faces of sides 2 and 3 must be capable of being heat sealed together either by virtue of the inherent nature of the film from which they are made or by means of coatings applied to the films rendering them heat sealable on both of their faces. When other sealing techniques are employed, the joinder of the sides 2 and 3 at the twin-Z-fold valve ends will be the same as just described.

The angularity at which the twin-Z fold valve 8 extends across the pouch has been found, within reasonable limits, to make little difference in the operation of the valve. For purposes of an exemplary showing, the valve 8 is illustrated in FIGS. 1 and 2 as forming angles of 45° with the adjacent pouch edges.

That portion of pouch 1 at the discharge end of the twin-Z-fold valve 8 (i.e. between the valve 8 and the corner 9) is intended to have a discharge opening formed therein. To this end, both sides 2 and 3 of the pouch may have identical, superimposed lines of weakening formed therein in any appropriate and well known manner. Such a line of weakening or notch in the side 2 is shown in FIG. 1 by broken line 14 and in the side 3 at **14*a* in FIG. 3. When the liquid commodity within pouch 1 is to be dispensed, the consumer simply tears the pouch along the lines of weakening 14 and 14*a* removing the corner 9 thereof and thereby forming a dispensing opening in the pouch spaced from the discharge end of the twin-Z-fold valve 8. The lines of weakening 14 and 14*a*** may be eliminated or substituted for by a simple indicia line in instances where it is intended that the consumer cut the pouch with a scissors or other appropriate implement to form a discharge opening.

Figure 3:
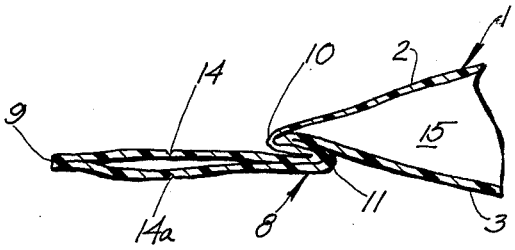
FIG. 3 is a fragmentary cross sectional view taken along section line 3—3 of FIG. 1 and illustrating the twin-Z-fold valve in its normal condition.

In that portion of the twin-Z-fold valve which extends between seal lines 4 and 6 (see FIG. 1) the pouch sides 2 and 3 are discrete and physically unattached. FIG. 3 is a cross sectional view taken along section line 3—3 of FIG. 1 and showing the line of weakening 14 in side 2 and the underlying line of weakening 14a in side 3. FIG. 3 illustrates the twin-Z-fold valve 8 in its normal condition wherein the sides 2 and 3 lie in abutment throughout a major portion of the twin-Z fold preventing the passage of the liquid commodity 15 therebeyond. The condition illustrated in FIG. 3 obtains when no squeezing force is applied to the pouch 1 and the liquid commodity 15 will be retained in the pouch even if the pouch is laid on its side or suspended with the twin-Z-fold valve 8 depending downwardly.

Figure 4:
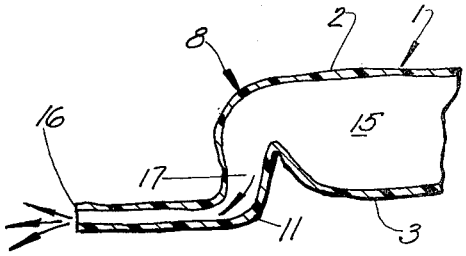
FIG. 4 is a fragmentary cross sectional view, similar to FIG. 3, and illustrating the twin-Z-fold valve in its dispensing condition.

FIG. 4 is a cross sectional view again taken along section line 3—3 of FIG. 1. FIG. 4, however, illustrates the pouch with corner 9 removed to form dispensing opening 16 and the condition of the twin-Z-fold valve 8 when a squeezing force is applied to the pouch 1. Under these circumstances, it will be evident from FIG. 4 that the first and second folds 10 and 11 of the twin-Z fold partially unfold resulting in the formation of a passage 17 between pouch sides 2 and 3 permitting the liquid commodity 15 to flow therethrough to the dispensing opening 16. The folds 10 and 11 are caused to become partially unfolded by the liquid pressure as a result of the squeezing force. Upon release of the squeezing force, the folds 10 and 11 will reclose and the twin-Z-fold valve 8 will prevent further passage of the liquid commodity therethrough to dispensing opening 16.

Returning to FIG. 1, the length of the twin-Z-fold valve 8 may be considered to be the distance between seal lines 4 and 6 at the ends of the valve. The width of the valve 8 may be considered to be the distance between the first and second fold lines 10 and 11. As a general rule it has been determined that as the length of the twin-Z-fold valve 8 is increased, the valve becomes easier to open but demonstrates less efficient reclosure. As the length of the valve 8 is decreased, it becomes more difficult to open and its reclosure characteristics improve. Similarly, as the width of the twin-Z-fold valve 8 is increased, the valve becomes harder to open and its reclosure characteristics improve. As the width of the valve 8 decreases, it becomes more easily openable, but demonstrates less efficient reclosure.

In designing a pouch of the type taught herein, the skilled worker in the art may vary the length and width dimensions of the twin-Z-fold valve 8 to achieve the desired trade-off between ease of opening and reclosability. These factors are affected by wetting ability and viscosity of the liquid product, pouch size and flexibility of the material from which the pouch sides 2 and 3 are made. Thus, as a general but not invariable rule, it has been found that as the wetting ability of the liquid product increases, as the viscosity of the liquid product decreases, as the size of the pouch decreases, or as the flexibility of pouch sides 2 and 3 increases, the twin-Z-fold valve 8 should be designed to be more easily reclosable. With the above teachings in mind, the design of the twin-Z-fold valve 8 is well within the skill of the worker of the art.

As an example, excellent results were achieved with a pouch of the type illustrated in FIG. 1 containing either water or a liquid detergent (having greater wetting ability than water). The pouch sides 2 and 3 were made of low density polyethylene having a thickness of 3 mils. The pouch was 100 mm long and 125 mm wide. The twin-Z-fold valve 8 formed angles of 45° with the adjacent pouch sides and the valve had a length of 24 mm and a width of 4 mm. The pouch demonstrated excellent dispensing characteristics and good reclosure.

Figure 10:
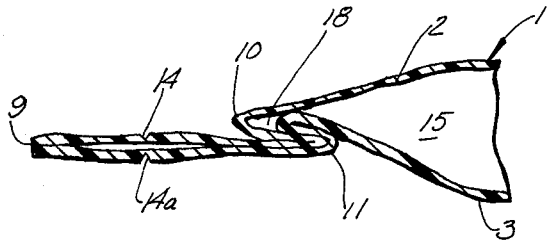
FIG. 10 is a fragmentary cross sectional view similar to FIG. 3 and illustrating the provision of a larger gap between the first and second pouch sides at the first fold of the twin-Z-fold valve.

FIG. 10 is substantially identical to FIG. 3 and like parts have been given like index numerals. The structure of FIG. 10 differs from that of FIG. 3 in that the sides 2 and 3 have been so folded as to provide a gap 18 therebetween at the first fold 10 of the twin-Z fold. It has been determined that as the gap 18 increases, the squeezing force required to dispense the liquid commodity 15 also increases. At the same time, the reclosure characteristices of the twin-Z-fold valve become more efficient. This is true because the presence of gap 18 results in the bulging of walls 2 and 3 tending to close the rest of the twin-Z-fold valve 8.

Figure 11:
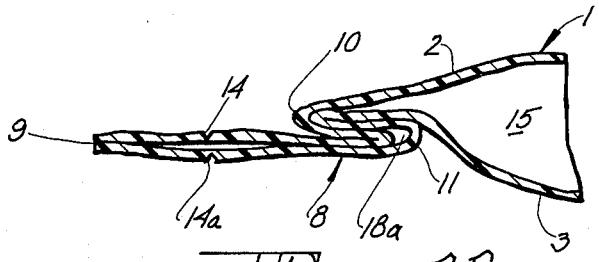
FIGS. 11 and 12 are fragmentary cross sectional views similar to FIGS. 3 and 10 and illustrating respectively the provision of a gap at the second fold and gaps at the first and second folds of the twin-Z-fold valve.

The sides 2 and 3 may be so folded as to provide a gap at the second fold 11 of the twin-Z fold. Such a gap is illustrated in FIG. 11, as at 18*a*. FIG. 11 is similar to FIG. 10 and like parts have been given like index numerals. Increasing the size of gap 18*a* increases the ease of dispensing and decreases the efficiency of reclosure.

Figure 12:
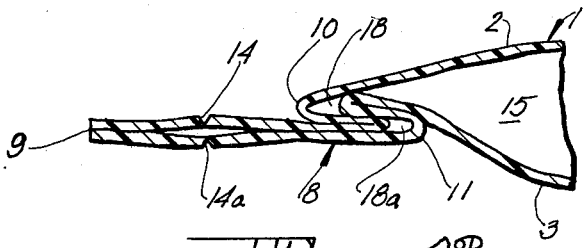

It is within the scope of the invention to provide a pouch with a gap 18 at fold 10 and a gap 18*a* at fold 11 so that the trade-off of the effects of both can be achieved. This is illustrated in FIG. 12 where like parts have again been given like index numerals. It has been determined that the effects of the gap 18 at fold 10 are greater and tend, to some extent at least, to override the effects of the gap 18*a* at fold 11.

The pouch 1 thus far described has been taught and illustrated as being of rectangular configuration. It will be understood by one skilled in the art that the pouch may have other appropriate peripheral configurations without departing from the spirit of the present invention. Similarly, the bottom edges of sides 2 and 3 (see FIG. 1), instead of being sealed together, might be sealed about an opening in a larger vessel (not shown), the pouch 1 serving as dispensing closure for the larger vessel. The reclosable construction of the present invention may be applied to pouches of more complex structure such as gusseted or tetrahedral pouches and the like. The pouch may serve as a conduit or a part of a pipeline or the like, the valve serving as a fluid pressure sensitive valve. As a consequence, the word "pouch" as used herein and in the claims is to be interpreted broadly as encompassing any appropriate liquid container or conduit having flexible film walls.

Figure 5:
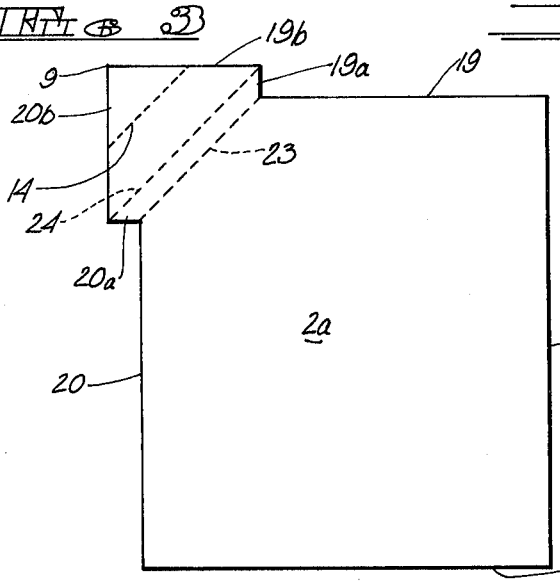
FIG. 5 is an elevational view of a film side or wall which may be utilized in the formation of a pouch provided with the reclosable dispensing valve of the present invention.

The pouch of FIG. 1 may be formed in various ways. Attention is now directed to FIG. 5 wherein one form of pouch side 2*a* is illustrated. The side 2*a*is substantially rectangular having a top edge 19, side edges 20 and 21 and bottom edge 22. The upper corner 9 of the pouch side is offset and extended. To accomplish this, the top edge 19 has a laterally offset portion 19*a* and a continuing, parallel portion 19*b*. Similarly, the side 20 has a laterally offset portion 20*a* and a continuing parallel portion 20*b*.

During assembly of the pouch, the side 2*a* will be folded diagonally from the juncture of edges 19 and 19*a* to the juncture of edges 20 and 20*a* along the imaginary fold line indicated by broken line 23. This will correspond to the first fold 10 of the twin-Z-fold valve. Similarly, the side 2*a* will be folded diagonally from the juncture of top edge portions 19*a* and 19*b* to the juncture of side edge portions 20*a* and 20*b* along an imaginary fold line indicated by broken line 24. This will correspond to the second fold 11 of the twin-Z-fold valve. Finally, the upper corner 9 will be provided with the notch or line of weakening 14.

Figure 6:
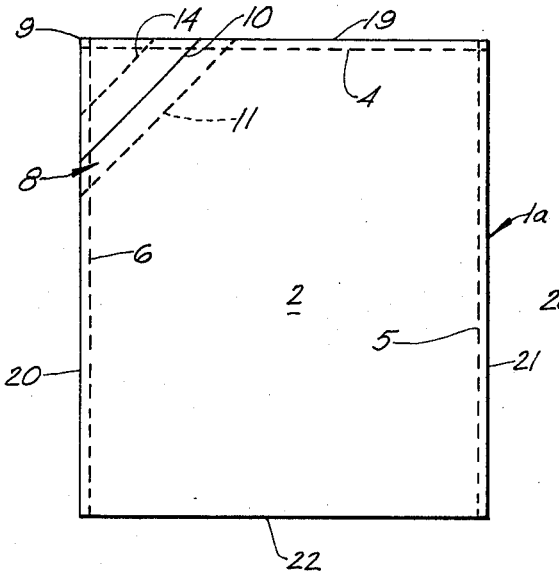
FIG. 6 is an elevational view of a pouch formed of two sides of the type illustrated in FIG. 5.

The side 2*a* of FIG. 5 will be superimposed upon a similarly configured side (not shown) and both of the sides will be folded along the fold lines 23 and 24. The top edge 19 and side edges 20 and 21 of pouch side 2*a*will then be sealed to the corresponding edges of the second pouch side along sealing lines 4, 5 and 6. The resulting pouch is illustrated in FIG. 6 and is identical to that of FIG. 1. The bottom edge 22 of side 2*a* remains unsealed to the corresponding bottom edge of the second pouch side so that the pouch may be filled with a liquid commodity via its bottom. Thereafter, the bottom edges of the sides may be sealed as at 7 (FIG. 1) to complete the structure. It will be understood by one skilled in the art that the side 2*a* of FIGS. 5 and 6 may differ slightly in dimension from the other pouch side to which it is affixed, if a gap 18, FIG. 10, a gap 18*a*, FIG. 11, or both gaps 18*a* and 18*b*, FIG. 12, are to be provided in the twin-Z-fold valve 8.

Figure 7:
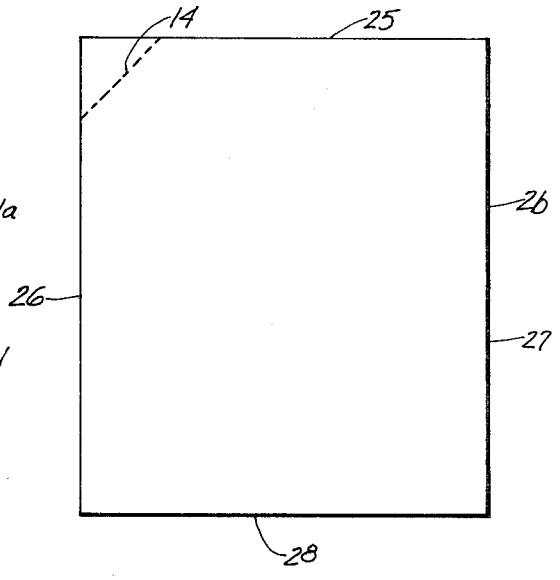
FIG. 7 is an elevational view of another film side or wall which may be used in the construction of a pouch provided with the reclosable dispensing valve of the present invention.

FIG. 7 illustrates another exemplary form of pouch side 2*b* which may be used to constitute the side 2 of the pouch 1 of FIG. 1. In this instance, the pouch side 2*b* has a simple rectangular configuration with a top edge 25, side edges 26 and 27 and a bottom edge 28. The side 2*b* may be provided with the diagonal notch or line of weakening 14. It will be understood that the line of weakening may be formed after assembly of the pouch.

Figure 8:
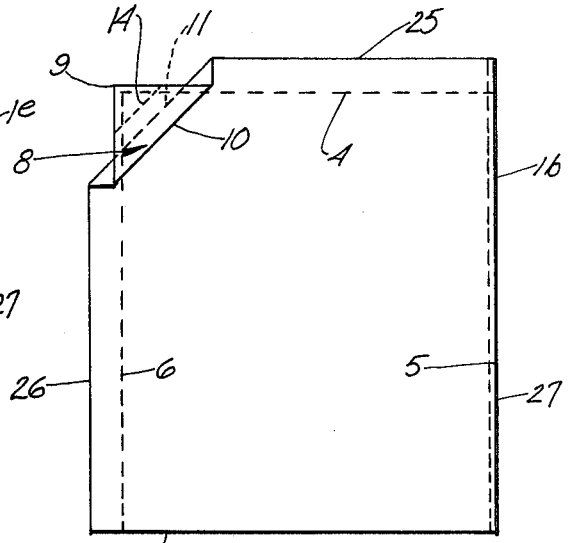
FIG. 8 is an elevational view of a pouch made up of two film sides of the type illustrated in FIG. 7.

FIG. 8 illustrates a pouch 1*b* formed of two sides of the type illustrated in FIG. 7. In this instance, the sides are superimposed and the twin-Z fold is made therein. The sides are then sealed together at 4, 5 and 6 in the same manner described with respect to FIG. 1. It will be noted, however, that the seal line 4 is spaced inwardly of the top edge 25 of the sides so that it can continue to the corner 9. The same is true of the seal 6. Upon trimming the excess material extending beyond seal lines 4 and 6, the resulting pouch will be identical to that of FIG. 1. Again, the pouch may be filled from its bottom and then sealed to complete the structure. Since pouch 1*b* is substantially identical when complete to pouch 1 of FIG. 1, like parts, where applicable, have been given like index numerals.

Figure 9:
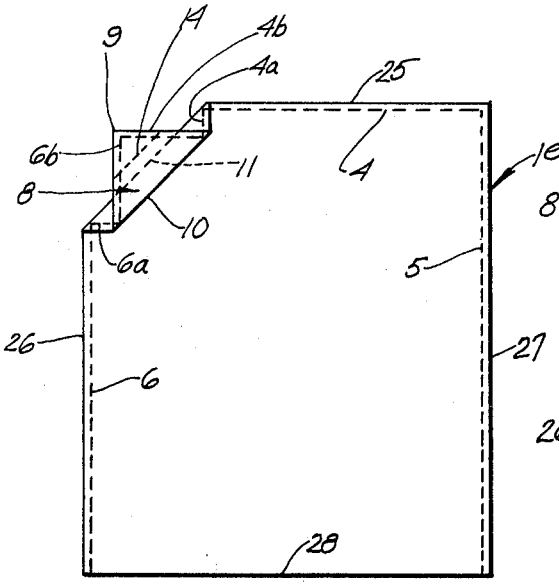
FIG. 9 is an elevational view of yet another pouch embodiment made up of two film sides of the type illustrated in FIG. 7.

FIG. 9 illustrates yet another pouch 1*c* made up of two side walls of the type illustrated at 2*b* in FIG. 7. Again, the pouch 1*c* is sufficiently similar to the pouch 1 of FIG. 1 that like parts, where applicable, have been given like index numerals. In this instance, once the twin-Z fold has been formed, the pouch is sealed as at 4, 5 and 6. The seal line 4 along the upper edge of the pouch, however, is provided with an inwardly extending portion 4*a* and a continuing parallel portion 4*b* terminating at the corner 9. In similar fashion the seal line 6 has an inturned portion 6*a* and a continuing parallel portion 6*b* terminating at the corner 9. The primary difference between the finished pouch 1*c* and the finished pouches 1 (FIG. 1) and 1*b* (FIG. 8) lies in the fact that the corner 9 is slightly inset. As a result, the length of the twin-Z-fold valve may be considered to be that portion of the twin-Z fold extending between seal lines 4*b* and 6*b*.

Modifications may be made in the invention without departing from the spirit of it. For example, although the pouches of FIGS. 1, 8 and 9 have been described as made up of two separate film sides sealed together, it is within the scope of the invention to form the pouch sides from a single sheet folded upon itself thereby eliminating one of the seals 4 through 7. The pouch may also be made from a film tube whereby seals 4 and 7 or 5 and 6 can be eliminated except at the ends of the twin-Z fold.

The embodiment of the invention in which an exclusive property or privilege is claimed are defined as follows:

1. A reclosable valve for controlling the flow of a liquid between first and second liquid-proof flexible films joined together in a fluid-tight seal along at least two spaced apart edge portions, said valve comprising a twin-Z fold incorporating both of said films and extending between said spaced apart edge portions, said twin-Z fold comprising first and second oppositely oriented and spaced folds in said films, said first and second films at said twin-Z fold therein being sealed together and to themselves at said spaced apart edge portions to maintain said twin-Z fold, said films at said twin-Z fold therein being discrete between said two spaced apart edge portions, whereby said twin-Z fold will partially unfold between said two edge portions to form a passage for said liquid when said valve is subjected to fluid pressure sufficient to cause said unfolding, said twin-Z fold refolding sufficiently to prevent further passage of said liquid therethrough when said fluid pressure is reduced to a value below that sufficient to cause said unfolding.

2. In a pouch of the type comprising first and second sides made of liquid-proof, flexible films, said sides being joined together along the pouch edges in a fluid-tight seal so that the pouch may contain a liquid product, said pouch being capable of having a dispensing opening formed therein in a predetermined opening zone, the improvement comprising a reclosable dispensing valve for said pouch, said valve comprising a twin-Z fold incorporating both of said pouch sides, said twin-Z fold being spaced inwardly of said opening zone and extending between two spaced apart pouch edge portions, said twin-Z fold comprising a first fold directing said pouch sides away from said opening zone and a second fold in spaced relationship to said first fold and directing said pouch sides toward said opening zone, said first fold being located between said second fold and said opening zone, said pouch sides at said twin-Z fold therein being sealed together and to themselves at said two spaced apart pouch edge portions to maintain said twin-Z fold, said pouch sides at said twin-Z fold therein being discrete between said two spaced apart pouch edge portions, whereby after a dispensing opening is provided in said opening zone, said twin-Z fold will partially unfold between said two edge portions to form a passage through which a liquid product in said pouch can be forwarded to and discharged through the dispensing opening when a squeezing force is applied to said pouch, said twin-Z fold refolding sufficiently to prevent further passage of said liquid product to said dispensing opening upon release of said squeezing force.

3. The structure claimed in claim 2 wherein said first and second folds are substantially parallel and are disposed at substantially equal angles with respect to said two spaced apart pouch edge portions.

4. The structure claimed in claim 2 including superposed lines of weakening in said pouch sides located in said opening zone along which lines said pouch sides may be torn to form said dispensing opening.

5. The structure claimed in claim 2 wherein said pouch is of rectangular peripheral configuration having four corners, said opening zone being disposed in one of said pouch corners.

6. The structure claimed in claim 2 including a gap formed between said first and second sides at said first fold therein.

7. The structure claimed in claim 2 including a gap formed between said first and second sides at said second fold therein.

8. The structure claimed in claim 6 further including a gap formed between said first and second sides at said second fold therein.

* * * * *